US007914215B2

(12) United States Patent
Tomatsu et al.

(10) Patent No.: US 7,914,215 B2
(45) Date of Patent: Mar. 29, 2011

(54) IMAGE FORMING APPARATUS

(75) Inventors: Yoshiya Tomatsu, Kasugai (JP); Masaki Yasuda, Nagoya (JP)

(73) Assignee: Brother Kogyo Kabushiki Kaisha, Nagoya-Shi (JP)

( * ) Notice: Subject to any disclaimer, the term of this patent is extended or adjusted under 35 U.S.C. 154(b) by 447 days.

(21) Appl. No.: 11/616,146

(22) Filed: Dec. 26, 2006

(65) Prior Publication Data

US 2007/0269246 A1 Nov. 22, 2007

(30) Foreign Application Priority Data

Dec. 27, 2005 (JP) ..... 2005-375590

(51) Int. Cl.
*B65H 23/34* (2006.01)

(52) U.S. Cl. ..... 400/625; 399/406; 400/642

(58) Field of Classification Search ..... 399/406; 400/642, 638, 639, 625; *B65H 23/34*
See application file for complete search history.

(56) References Cited

U.S. PATENT DOCUMENTS

| | | | | |
|---|---|---|---|---|
| 5,870,662 | A * | 2/1999 | Tomatsu | 399/406 |
| 5,933,697 | A * | 8/1999 | Onodera et al. | 399/406 |
| 6,094,561 | A * | 7/2000 | Ushio | 399/401 |
| 6,246,860 | B1 * | 6/2001 | Ohmichi | 399/406 |
| 7,530,750 | B2 * | 5/2009 | Ho | 400/649 |
| 2004/0240913 | A1 * | 12/2004 | Tomatsu | 399/328 |

FOREIGN PATENT DOCUMENTS

| | | | |
|---|---|---|---|
| JP | 03-056355 | | 3/1991 |
| JP | 6-183628 | | 7/1994 |
| JP | 8-175733 | | 7/1996 |
| JP | 09-188458 | | 7/1997 |
| JP | 09-295401 | | 11/1997 |
| JP | 10-139248 | | 5/1998 |
| JP | 2000-284623 | | 10/2000 |
| JP | 2001261211 | A * | 9/2001 |
| JP | 2000-056530 | | 2/2002 |

OTHER PUBLICATIONS

Office Action received for Japanese Application No. 2005-375590 dated Oct. 21, 2008.

* cited by examiner

*Primary Examiner* — Judy Nguyen
*Assistant Examiner* — Jennifer Simmons
(74) *Attorney, Agent, or Firm* — Banner & Witcoff, Ltd.

(57) ABSTRACT

An image forming apparatus includes an image forming unit which forms an image on a recording sheet, a casing which houses the image forming unit and holds the image forming units, a conveying roller which applies a conveying force to the recording sheet by contacting with the recording sheet, a first roller which is fixed to a position confronting the conveying roller, the first roller pushing the recording sheet toward the conveying roller and being rotatable, a second roller which is arranged at a position confront the conveying roller and downstream side of the first roller in a conveying direction, the second roller being displaceable, and a roller displacing mechanism which displaces the second roller in such a manner as to change a distance between the second roller and the conveying roller.

12 Claims, 9 Drawing Sheets

IMAGE FORMING APPARATUS

CROSS-REFERENCE TO RELATED APPLICATION

This application claims priority from Japanese Patent Application No. 2005-375590, filed on Dec. 27, 2005, the entire subject matter of which is incorporated herein by reference.

TECHNICAL FIELD

Aspects of the present invention relate to an image forming apparatus applicable to an electrophotographic image forming apparatus such as a laser printer or a copying machine.

BACKGROUND

An image forming apparatus usually prints an image such as letters or the like on a recording face of a recording sheet while conveying the recording sheet on a conveying path set in the image forming apparatus (or a casing thereof). If the recording sheet passes through a curved conveying path, the recording sheet may have a bending tendency (or a curl).

Therefore, the bending tendency is offset and eliminated usually by curving the recording sheet in a direction opposite to the bending tendency. As specific means for curving the recording sheet in a direction opposite to the bending tendency, there is known an uncurling mechanism, which includes a conveying roller and a pair of follower rollers arranged along a circumference direction of the conveying roller and confronting the conveying roller.

In this uncurling mechanism, the pair of follower rollers winds the recording sheet on the conveying rollers so that the recording sheet is curved in the direction opposite to the bending tendency thereby to offset and remove the bending tendency.

However, different recording sheets have different warping rigidity and different bending tendency in accordance with their kinds. Thus, the bending tendency of all kinds of the recording sheets may not be properly cleared if they are forcibly curved under a common condition.

JP-A-6-183628 discloses a configuration in which a pair of follower rollers are integrated by a support plate or the like, and the support plate is moved in parallel with the conveying direction of the recording sheet. The Support plate is moved such that one of the pair of follower rollers is brought into contact with the recording sheet on the conveying roller in one case, and the one of the follower rollers is separated from the recording sheet in another case. Thus, various kinds of recording sheets can be dealt with.

JP-A-8-175733 discloses a configuration in which the follower roller on the upstream side in the conveying direction is moved in parallel with a direction perpendicular to the conveying direction such that the follower roller is brought into and out of contact with the recording sheet on the conveying roller, so that various kinds of recording sheets can be dealt with.

SUMMARY

In the configuration disclosed in JP-A-6-183628, however, the support plate is moved in parallel with the conveying direction of the recording sheet, thereby to switch the cases, in which one of the pair of follower rollers is brought into and out of contact with the conveying rollers of the recording sheet. As a result, the distance between the rotation center of the other follower roller and the rotation center of the conveying roller varies as the one follower roller is brought into and out of contact with the conveying roller.

When the distance between the rotation center of the follower rollers and the rotation center of the conveying roller varies, the contacting facial pressure between the follower rollers and the conveying roller changes so that the recording sheet cannot be stably conveyed.

If the contacting facial pressure becomes excessively high, a roller scar may be formed to damage the recording sheets when the recording sheet is clamped between the conveying roller and the follower rollers. If the contacting facial pressure becomes excessively low, on the contrary, the recording sheet cannot be sufficiently clamped so that it cannot be stably conveyed.

In the configuration disclosed in JP-A-8-175733, on the other hand, since the follower roller on the upstream side of the conveying direction is switchably moved to be brought into and out of contact with the recording sheet on the conveying roller, the recording sheet cannot be stably conveyed for the reasons to be described later.

Aspects of the present invention provide an image forming apparatus which can remove the bending tendency reliably for various kinds of recording sheets.

DETAILED DESCRIPTION

General Overview

Figure 1:
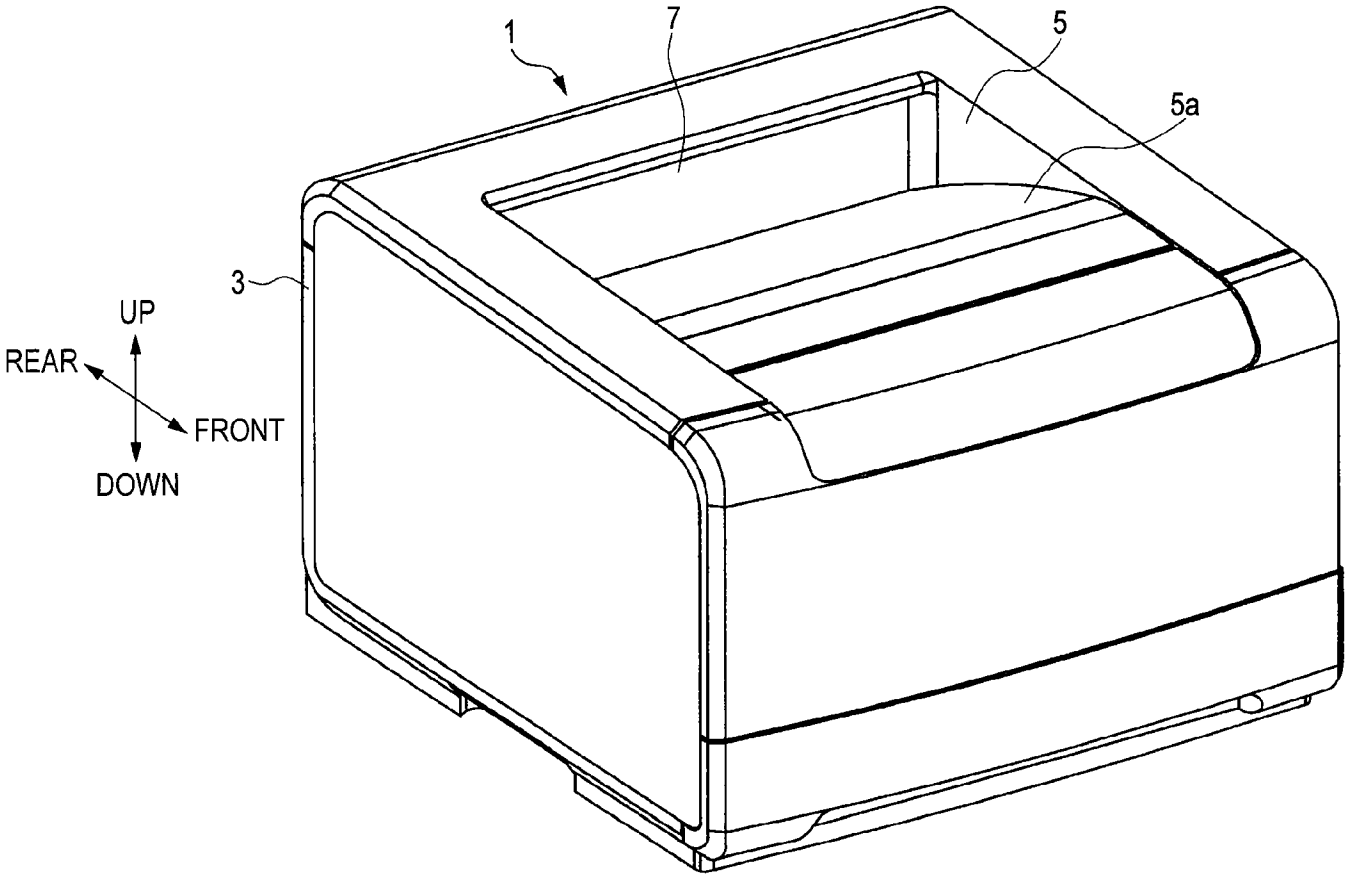
FIG. 1 is a perspective view showing the exterior of a laser printer according to an aspect of the invention.

According to a first aspect of the invention, there is provided an image forming apparatus comprising: an image forming unit which forms an image on a recording sheet; a casing which houses the image forming unit and holds the image forming unit; a conveying roller which applies a conveying force to the recording sheet by contacting with the recording sheet; a first roller which is fixed to a position confronting the conveying roller, the first roller pushing the recording sheet toward the conveying roller and being rotatable; a second roller which is arranged at a position confront the conveying roller and downstream side of the first roller in a conveying direction, the second roller being displaceable; and a roller displacing mechanism which displaces the second roller in such a manner as to change a distance between the second roller and the conveying roller.

According to a second aspect of the invention, the image forming apparatus further comprises a first guide unit which is disposed in an upstream side of a contact portion between the first roller and the second roller in the conveying direction and guides the recording sheet to the contact portion.

According to a third aspect of the invention, the image forming apparatus further comprises a second guide unit which has a guide portion continuing from the upstream side of the conveying roller in the conveying direction to the downstream side of the conveying roller in the conveying direction and guides the recording sheet.

According to a fourth aspect of the invention, if the second roller is spaced from the conveying roller, the recording sheet discharged from the conveying roller is conveyed to the downstream side being in contact with the second guide unit but without colliding with the second roller.

According to a fifth aspect of the invention, the image forming apparatus further comprises a third guide unit which guides the recording sheet discharged from the conveying roller to the downstream side without colliding with the second roller if the second rollers are the most spaced from the conveying rollers.

According to a sixth aspect of the invention, the first roller and the second roller are connected by a roller holder, and the second roller is rocked and displaced on a rotation center of the first roller.

According to a seventh aspect of the invention, the roller displacing mechanism includes a cam plate which extends substantially in parallel with the rotation axis direction of the conveying roller and is movable in parallel with the same direction, and the cam plate includes a grip portion which operates the cam plate at a longitudinal end portion thereof.

According to an eighth aspect of the invention, the image forming unit includes a fixing unit which heats a toner transferred to the recording sheet and fixes the toner on the recording sheet, and the conveying roller is arranged in a downstream side of the fixing unit in the conveying direction.

According to a ninth aspect of the invention, the image forming apparatus further comprises a discharge roller which discharges the recording sheet having ended an image formation to a discharge tray in a downstream side of the conveying roller in the conveying direction.

According to a tenth aspect of the invention, The image forming apparatus further comprises a guide member which is disposed in the downstream side of the fixing unit in the conveying direction and an upstream side of the discharge rollers in the conveying direction and guides the recording sheet while curving the same, wherein the conveying roller is arranged to curve the recording sheet in a direction opposite to the curvature by the guide member.

<Illustrative Aspects>

With reference to the accompanying drawings, aspects of the invention will be described, in which an image forming apparatus is applied to an apparatus such as a laser printer.

1. Exterior Structure of Laser Printer

FIG. 1 is a perspective view showing the exterior of a laser printer 1 according to the aspect of the invention.

The laser printer 1 has a substantially box-shaped (or stereoscopic) casing 3, in which a later-described image forming unit 10 or the like is housed. A discharge tray 5 is provided on an upper face side of the casing 3. Recording sheets discharged from the casing 3 after printing are stacked on the discharge tray 5. In this aspect, sheets such as paper sheets or OHP sheets may be used as the recording sheets.

The discharge tray 5 is configured to have such a slope face 5*a* which increases in slope the farther the distance from an upper face of the casing 3 the closer to a rear side. A discharge port 7, from which the printed recording sheet is discharged, is provided on a rear end side of the slope face 5*a*.

2. Internal Structure of Laser Printer

Figure 2:
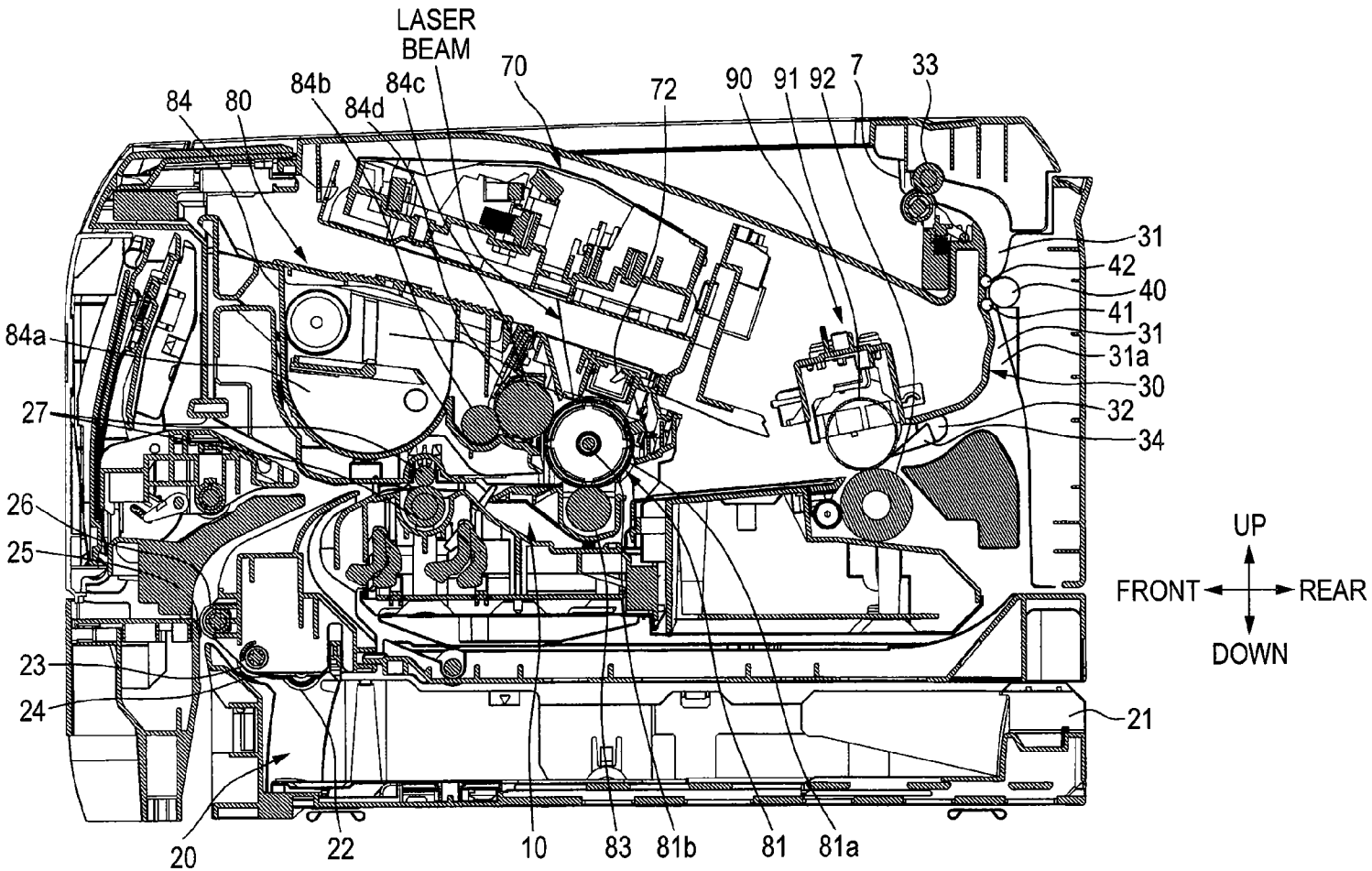
FIG. 2 is a sectional side view of the laser printer.

FIG. 2 is a sectional side view of the laser printer 1. The image forming unit 10 form images on the recording sheets. A feeder unit 20 constitutes a portion of a conveying unit for feeding the recording sheets to the image forming unit 10.

A discharge chute 30 constitutes a guide member for causing the recording sheet having formed with the image at the image forming unit 10 to make a U-turn of about 180 degrees in the conveying direction and to turn upside-down so as to guide the recording sheet into the discharge port 7 formed above a fixer unit 90.

The intermediate conveying rollers 40 for conveying the recording sheet to the discharge port 7 are disposed at the intermediate portion of the conveying path 31, which is formed by the discharge chute 30. A turning roller 32 for guiding the recording sheets which is discharged from the fixing unit 90 (or a heating roller 91), to turn about 90 degrees in the conveying direction upward, is disposed on an exit side of the fixing unit 90. Discharge rollers 33, which discharge the conveyed recording sheet to the discharge tray 5, are disposed at the most downstream portion of the conveying path 31.

2.1. Feeder Unit

The feeder unit 20 includes a sheet feed tray 21, a sheet feed roller 22, a separating roller 23 and a separating pad 24. The sheet feed tray 2 is housed in the lowermost portion of the casing 3. The sheet feed roller 22 is disposed above the front end portion of the sheet feed tray 21 for conveying the recording sheets to the image forming unit 10. The separating roller 23 and the separating pad 24 separate one by one the recording sheets to be conveyed to the sheet feed roller 22. The recording sheets, which are stacked on the sheet feed tray 21, are conveyed, after being U-turned on the front side in the casing 3, to the image forming unit 10 arranged substantially at the center portion in the casing 3.

In the recording sheet conveying path from the sheet feed tray 21 to the image forming unit 10, a paper dust removing roller 25 is provided on the outer side of the top portion of the substantially U-shaped turn. The paper dust removing roller 25 removes the paper dust or the like which has stuck to the image forming face (or the printing face) of the recording sheet. An opposed roller 26 for pushing the conveyed recording sheet to the paper dust removing roller 25 is provided on the inner side of the top portion.

At the entrance of the image forming unit 10 of the conveying path from the sheet feed tray 21 to the image forming unit 10, moreover, there are arranged a pair of resister rollers 27 for applying a conveying resistance to the recording sheet thereby to arrange the conveyed state of the recording sheet.

2.2. Image Forming Unit

The image forming unit 10 includes a scanner unit 70, a process cartridge 80 and a fixing unit 90.

2.2.1. Scanner Unit

The scanner unit 70 is disposed in the upper portion of the casing 3 and forms an electrostatic latent image on the surface of a photosensitive drum 81. Specifically, the scanner unit 70 includes a laser light source, a polygon mirror, an fθ lens and reflecting mirrors.

The laser beam, which is emitted from a laser light source and based on the image data, is deflected by the polygon mirror and passed through the fθ lens. The optical path is then folded back and bent downward by the reflecting mirrors so that the surface of the photosensitive drum 8 is irradiated with the laser beam to form the electrostatic latent image.

2.2.2. Process Cartridge

The process cartridge 80 is removably arranged in the casing 3 on the lower side of the scanner unit 70. This process cartridge 80 includes the photosensitive drum 81, a charger 82, a transfer roller 83 and a developer cartridge 84.

The photosensitive drum 81 acts as an image carrying unit for carrying the image to be transferred to the recording sheet. The photosensitive drum 81 includes a cylindrical drum body 81*a* having its outermost layer made of a positively chargeable photosensitive layer such as polycarbonate, and a drum shaft 81*b* extending axially and longitudinally in the drum body 81*a* for supporting the drum body 81*a* rotatably.

The charger 82 acts as a charging unit for charging the surface of the photosensitive drum 81. The charger 82 is so arranged obliquely above the rear side of the photosensitive drum 81 to confront the photosensitive drum 81 across a predetermined spacing so that it does not contact the photosensitive drum 81. The charger 82 may be a scorotron type charger for charging the surface of the photosensitive drum 81 substantially uniformly with a positive charge by corona discharge.

The transfer roller 83 is arranged to confront the photosensitive drum 81 and to rotate in association with the photosensitive drum 81. This transfer roller 83 acts as a transfer unit for transferring the toner having stuck to the surface of the photosensitive drum 81 to the printing surface of the recording sheet. The transfer roller 83 transfers the toner by causing the charge (i.e., the negative charge), which is opposite to the charge at the photosensitive drum 81, to act on the recording sheet from the side opposite to that of the printing face.

The discharge chute 30 includes a toner housing chamber 84*a* housing the toner, a toner feed roller 84*b* for feeding the toner to the photosensitive drum 81, and a developing roller 84*c*.

The toner, which is housed in the toner housing chamber 84*a*, is fed toward the developing roller 81*c* by the rotation of the toner feed roller 84*b*. The toner fed toward the developing roller 84*c* is carried on the surface of the developing roller 84*c*. After regulated to a predetermined constant (or uniform) thickness, the toner is fed to the surface of the photosensitive drum 81 exposed by the scanner unit 70.

2.2.3. Fixing Unit

The fixing unit 90 is arranged on the down stream side of the photosensitive drum 81 in the conveying direction of the recording sheet. The fixing unit 90 fixes the toner, which is transferred to the recording sheet, by heating and melting the toner. Specifically, the fixing unit 90 includes a heating roller 91 and a pressure roller 92. The heating roller 91 is arranged on the printing face side of the recording sheet for applying the conveying force, while heating the toner, to the recording sheet. The pressure roller 92 is arranged on the opposite side of the heating roller 91 across the recording sheet and pushes the recording sheet toward the heating roller 91.

Incidentally, the heating roller 9 is driven by a unit such as a motor (not shown), and the pressure roller 92 follows and rotates while receiving the rotating force from the heating roller 91 through the recording sheet contacting with the heating roller 91.

2.2.4. Actions of Image Forming Unit

The drum 8 is uniformly and positively charged by the charger 82 as it rotates, and is then exposed to the laser beam which is irradiated from and scanned at a high speed by the scanner unit 70. As a result, the electrostatic latent image corresponding to the image to be formed on the recording sheet is formed on the surface of the photosensitive drum 81.

Next, the toner, which is carried on the developing roller 84*c* and positively charged, is fed to the electrostatic latent image formed on the surface of the photosensitive drum 81 when brought to face and contact with the photosensitive drum 81 by the rotation of the developing roller 84*c*. Namely, the roller is fed to such an exposed portion in the uniformly and positively charged surface of the photosensitive drum 8 which has been exposed to the laser beam to lower its potential. As a result, the roller image by the reversal phenomenon is carried on the surface of the photosensitive drum 81.

The toner image, which is carried on the surface of the photosensitive drum 81, is transferred to the recording sheet by the transfer bias applied to the transfer roller 83. The recording sheet having the toner image transferred is conveyed to and heated by the fixing unit 90 go that the toner transferred as the roller image is fixed on the recording sheet. Thereby, the image formation is completed.

2.3. Discharge Chute 30 and Intermediate Conveying Rollers 40

2.3.1. Structures of Discharge Chute 30 and Intermediate Conveying Rollers 40

Figure 3:
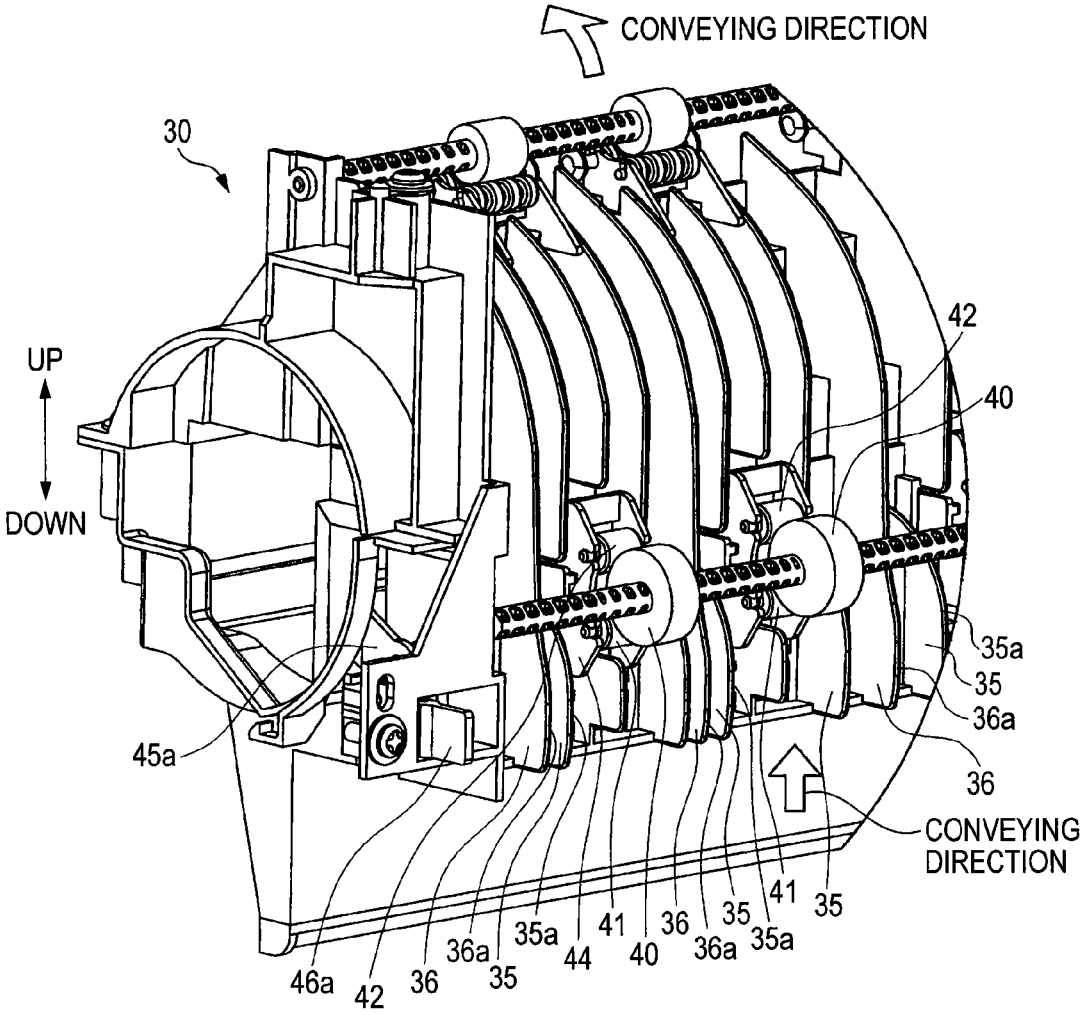
FIG. 3 is an enlarged view of a discharge chute and intermediate conveying rollers.
Figure 4:
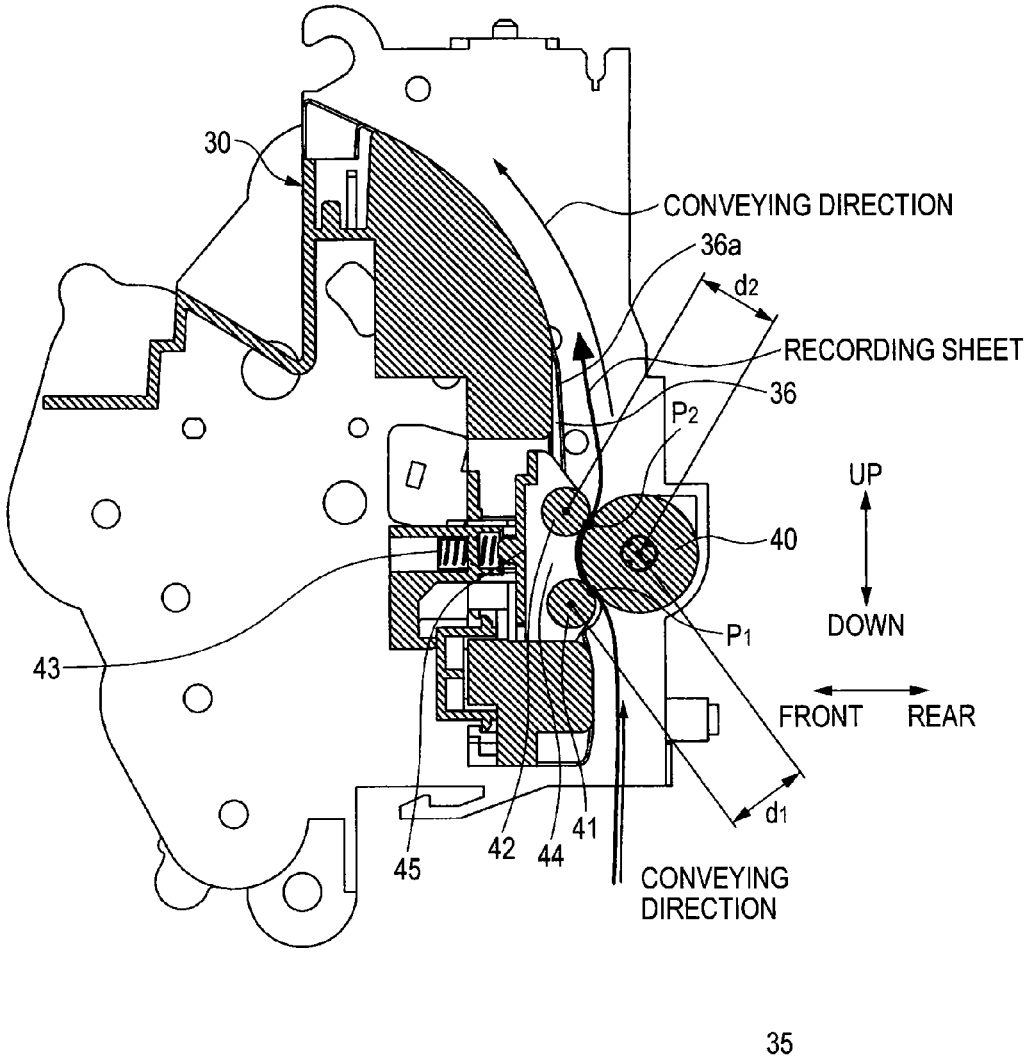
FIG. 4 is a sectional view taken of FIG. 3 from a plane being normal to an axial direction of the intermediate conveying rollers.
Figure 5:
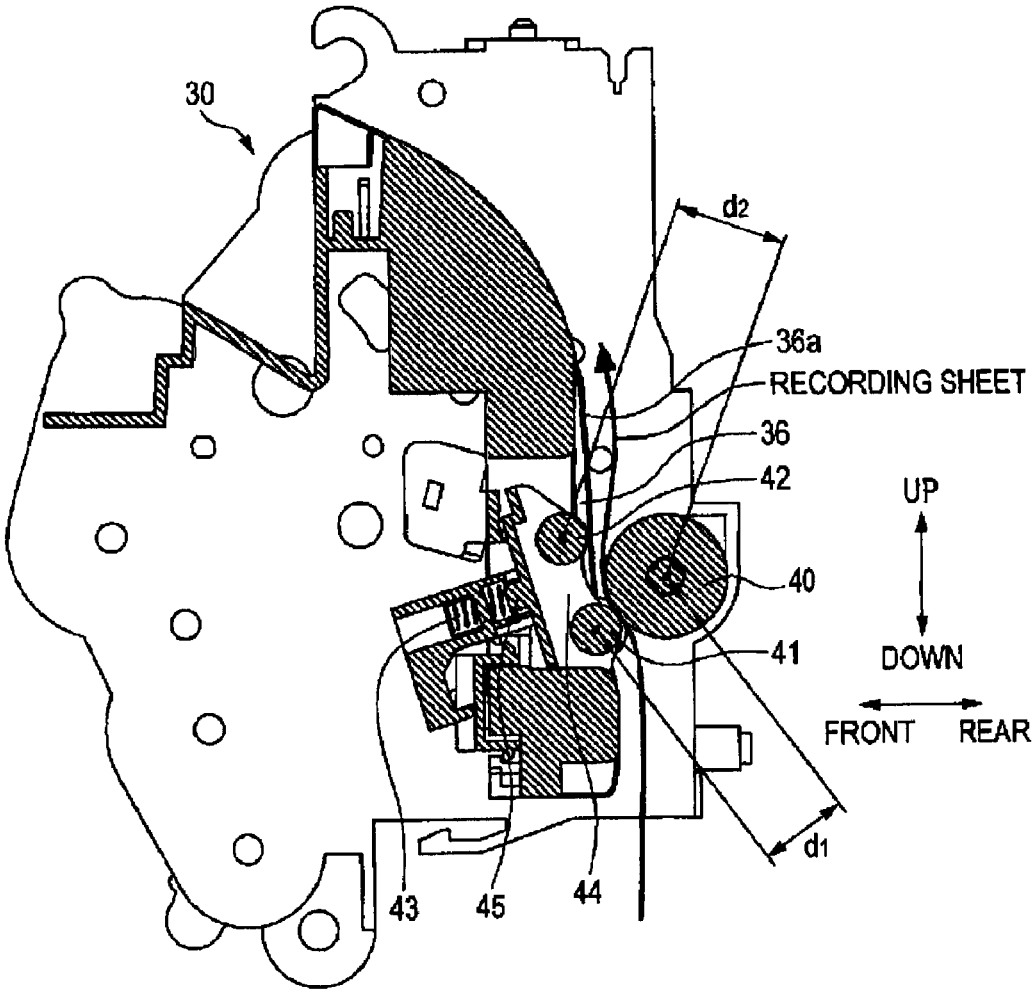
FIG. 5 is another sectional view taken of FIG. 3 from a plane being normal to the axial direction of the intermediate conveying rollers.
Figure 6:
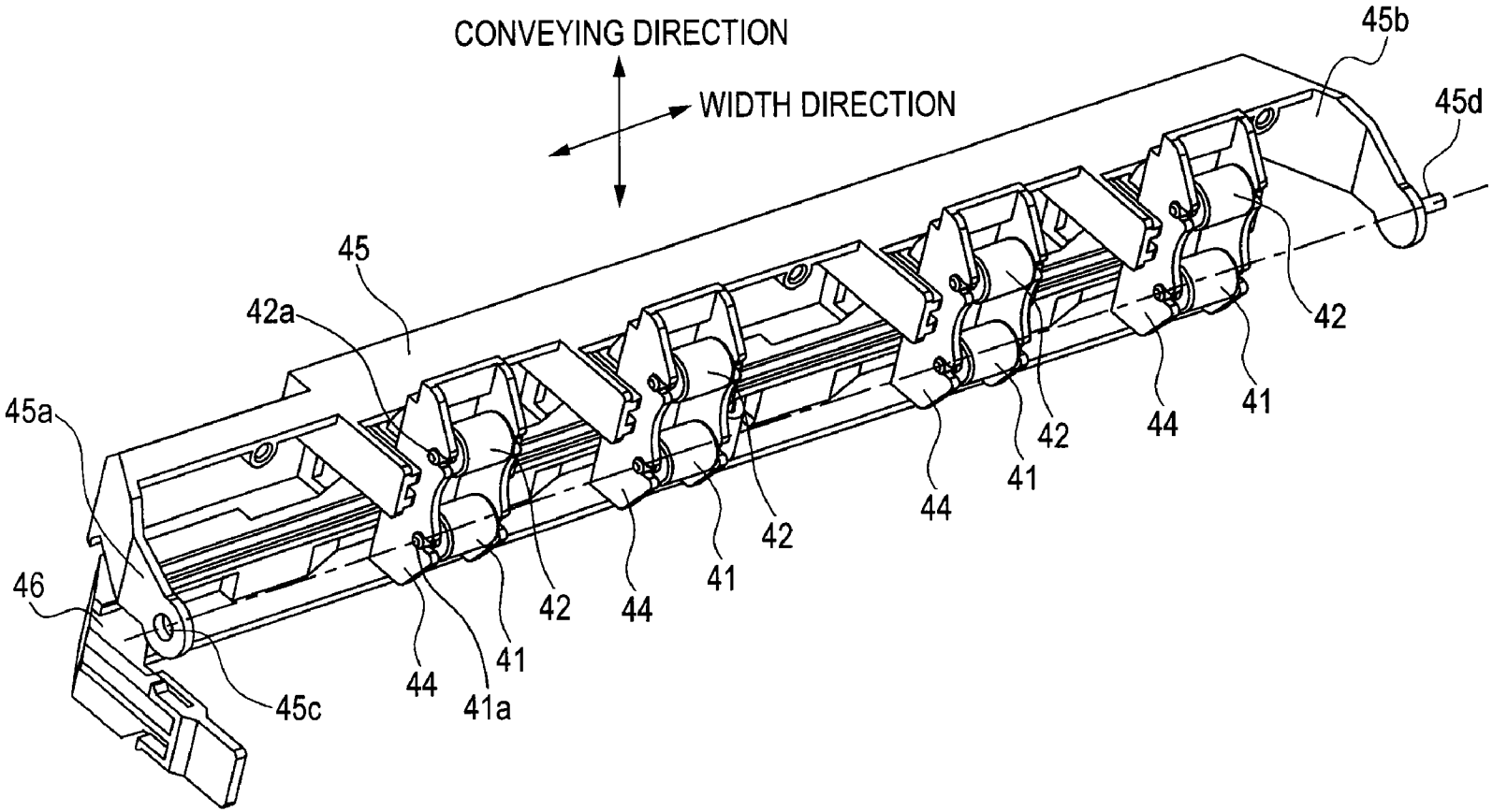
FIG. 6 is a perspective view of the follower rollers.
Figure 7:
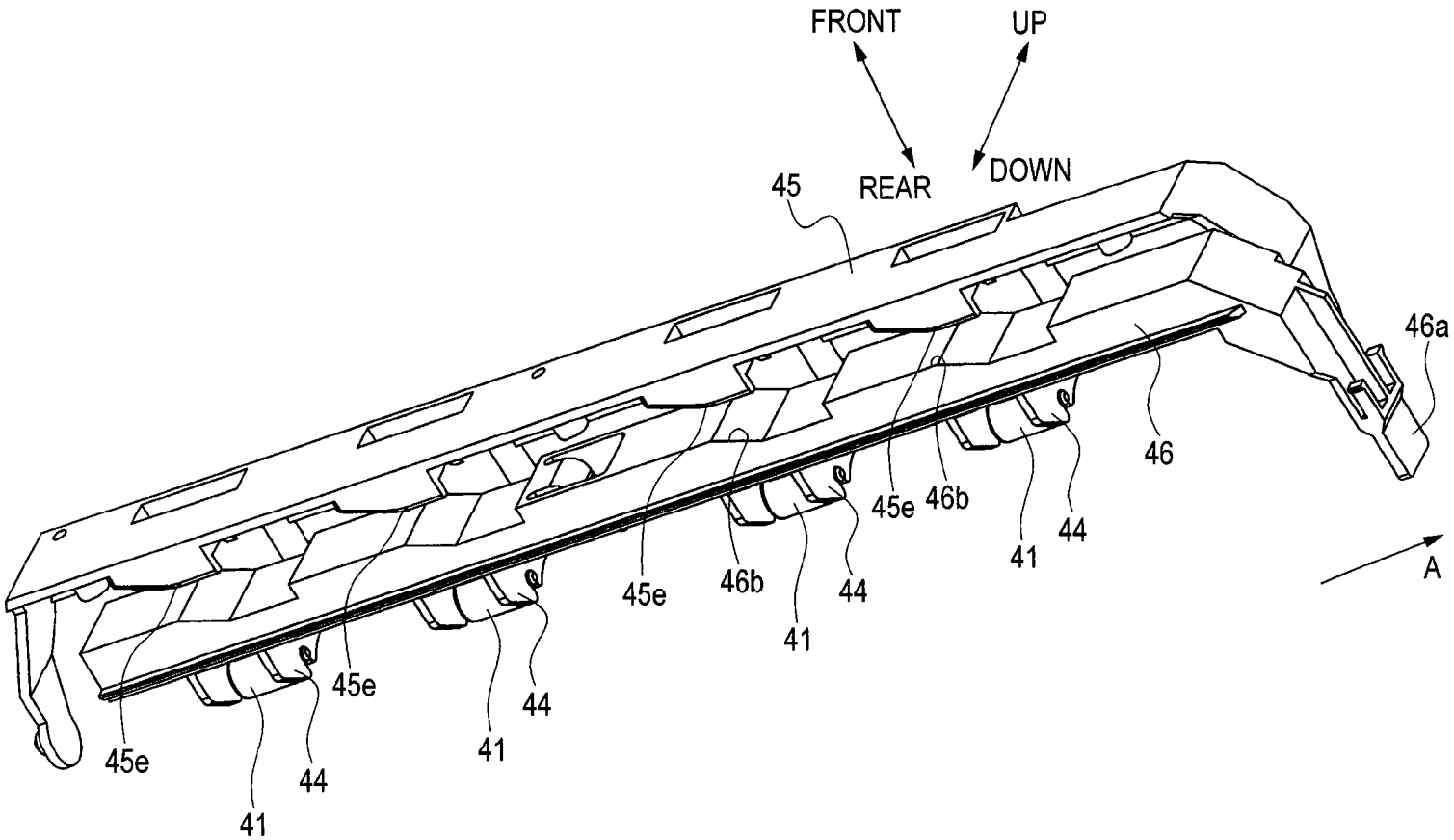
FIG. 7 is a perspective view taken from a rear side of FIG. 6.
Figure 8:
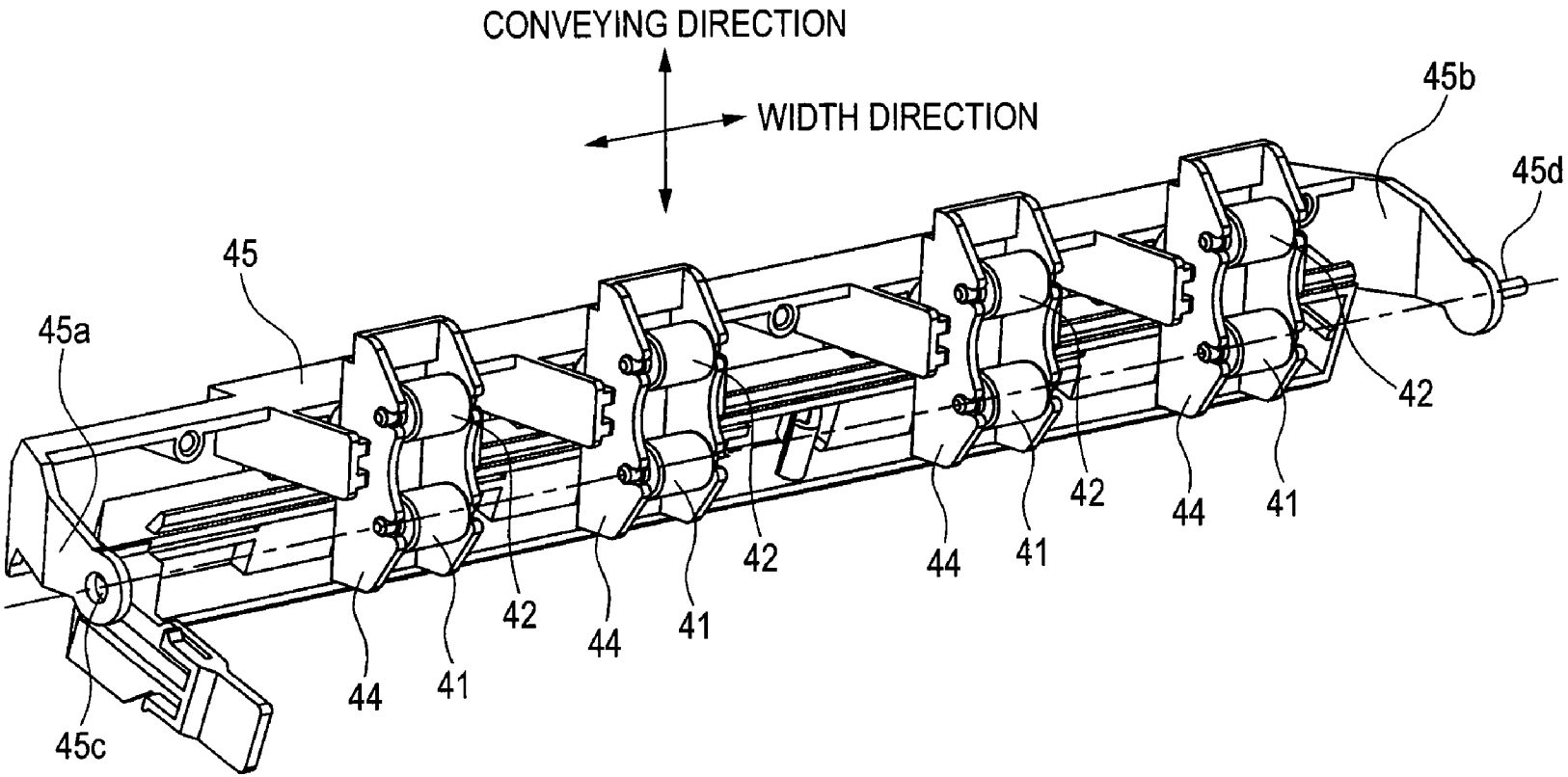
FIG. 8 is another perspective view of the follower rollers.
Figure 9:
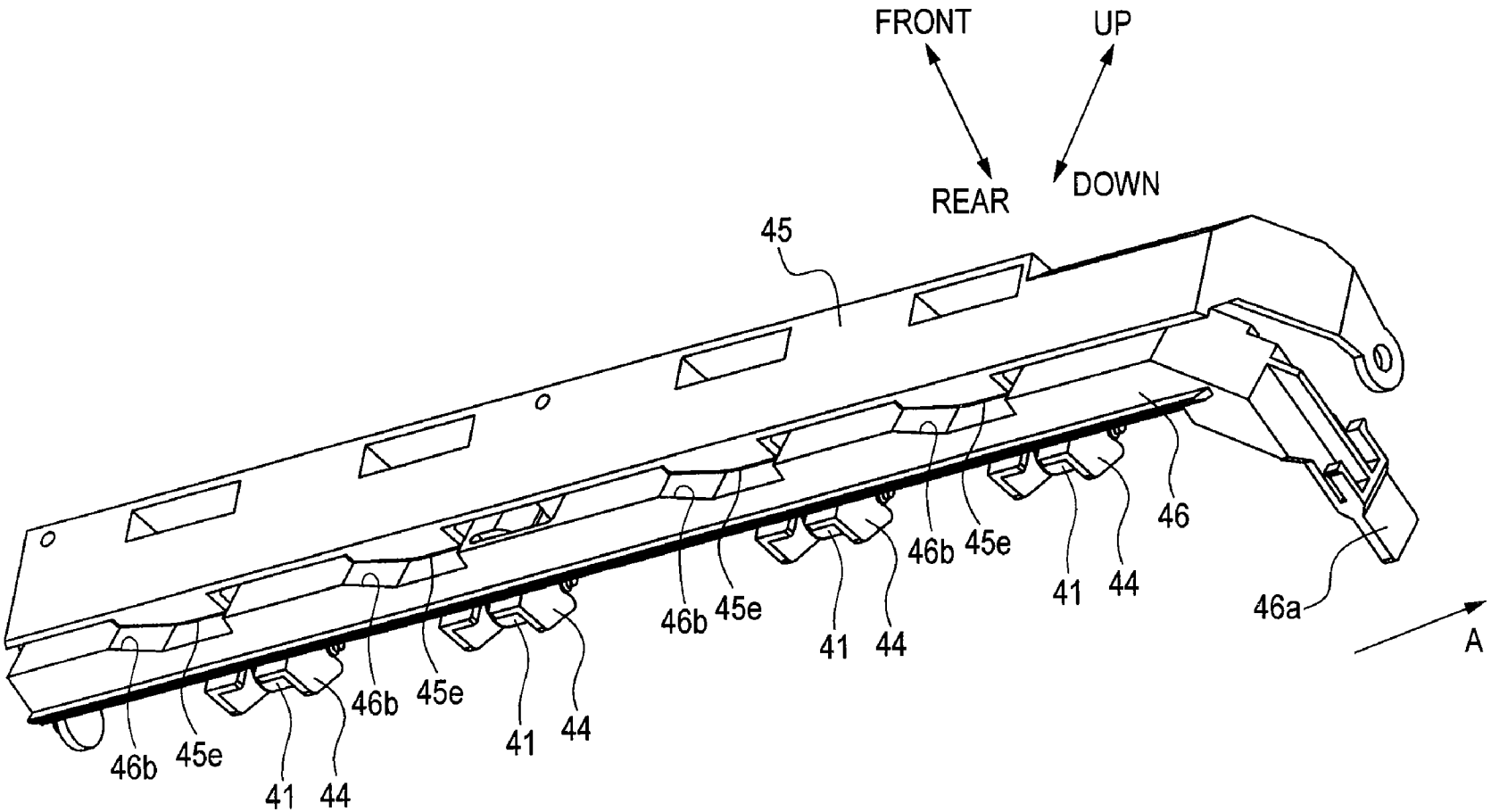
FIG. 9 is another perspective view taken from the rear side of FIG. 6.

FIG. 3 is an enlarged view of the discharge chute 30 and the intermediate conveying rollers 40. FIG. 4 and FIG. 5 are sectional views taken along a plane in FIG. 3, plane being normal to the axial direction of the intermediate conveying rollers 40. FIG. 6 and FIG. 8 are perspective views of follower rollers 41 and 42 and so on. FIG. 7 is a perspective view taken from the rear side of FIG. 6. FIG. 9 is a perspective view taken from the rear side of FIG. 8.

The discharge chute 30 constitutes a guide wall for turning the recording sheet, discharged from the fixing unit 90 (or the heating roller 91), as shown in FIG. 2, upward by about 180 degrees thereby to guide the recording sheet to the discharge rollers 33. On the upstream side of the turning roller 32 in the conveying direction, there is arranged a peeling blade 34 for peeling the recording sheet, heated at the heating roller 91, from the heating roller 91.

The intermediate conveying rollers 40, which are disposed at the intermediate portion of the conveying path 31, come into contact with the discharged recording sheet from the fixing unit 90, thereby to apply the conveying force to the recording sheet. At the position confronting the intermediate conveying rollers 40 across the recording sheet to be conveyed, there is arranged the pair of follower rollers 41 and 42, which is pushed to the side of the intermediate conveying rollers 40 by urging unit (coil springs, as shown in FIG. 4).

As a result, the pair of follower rollers 41 and 42 pushes the conveyed recording sheet to the side of the intermediate conveying rollers 40, and rotates while following the conveyance of the recording sheet. The follower rollers on the upstream side in the conveying direction will be called the first follower rollers 41, and the follower rollers on the downstream side in the conveying direction will be called the second follower rollers 42.

At least an outer circumference of the intermediate transfer roller 40 is made of an elastically deformable elastic material such as rubber. The pair of follower rollers 41 and 42 is made of a hard material such as a resin.

The first follower rollers 41 and the second follower rollers 42 are connected by roller holders 14 such that they are rotatably supported by the roller holders 44 through roller shafts 41*a* and 42*a*. The pair of follower rollers 41 and 42, which is connected by the roller holders 44 to form the pairs, is juxtaposed in pairs in the widthwise direction (as will be called the sheet width direction) of the recording sheet to be conveyed, as shown in FIG. 6 and FIG. 8.

The sheet width direction is a direction perpendicular to both the conveying direction of the recording sheet and the thickness direction of the recording sheet. The sheet width direction is aligned with the rotation axis direction of the intermediate conveying rollers 40.

The individual roller holders 44 are fixed to a holder stay 45 extending in the sheet width direction. The holder stay 45 is assembled with the casing 3 such that the holder stay 45 rotatable at a position corresponding to the rotation centers of the first follower rollers 41.

In this aspect, arm portions 45*a* and 45*b*, which extend in parallel with the roller holders 44, are provided on the two end sides of the longitudinal direction in the holder stay 45. The arm portion 45*a* on one side has a pin hole 45*c*, into which a pin (not shown) formed on the casing 3 is rotatably inserted. The arm portion 45*b* on the other side has a pin 45*d*, which is rotatably inserted into a pin hole (not shown) formed in the casing 3.

When viewed in the sheet width direction, the rotation centers of the pin hole 45*c* and the pin 45*d* are substantially aligned with the rotation center of the first follower rollers 41, as shown in FIG. 6 and FIG. 8. Therefore, as the holder stay 45 rotates (or rocks), the rotation center of the first follower rollers 41 do not move, whereas the rotation center of the second follower rollers 42 rotate (or rock) on the rotation center of the first follower rollers 41.

In other words, the center distance d1 between the first follower roller 41 and the intermediate conveying roller 40 is constant at all times irrespective of the state of the holder stay 45, whereas the center distance d2 between the second follower roller 42 and the intermediate conveying roller 40 changes with the state of the holder stay 45, as shown in FIG. 4 and FIG. 5.

As shown in FIG. 7 and FIG. 9, the holder stay 45 has cam faces 45*e* protruding in a substantially trapezoidal shape. On the other hand, a cam plate 46 is assembled to the casing 3 such that the cam plate 46 is movable in parallel with the aforementioned rotation axis direction. The cam plate 16 extends in the rotation axis direction (or the sheet width direction) of the intermediate conveying roller 40 and has cam faces 46*b* come into contact with the cam faces 45*e*.

As shown in FIG. 7 and FIG. 9, a grip portion 46*a*, which is manually operated by a user to move the cam plate 46 in the A-direction or in the opposite direction, is provided on one end side in the longitudinal direction of the cam plate 46. When the cam plate 46 is brought relative to the holder stay 45 to a position shown in FIG. 7, in which the A-direction side end portion of the cam plate 46 is positioned on the side of the A-direction with respect to the A-direction side end portion of the holder stay 45, the cam faces 45*e* of the holder stay 45 are lifted by the cam faces 46*a* of the cam plate 46.

As a result, the holder stay 45 takes the state, in which both the pair of follower rollers 41 and 42 contacts with the intermediate conveying roller 40, as shown in FIG. 4. On the other hand, when the cam plate 16 is brought to a position shown in FIG. 9 with respect to the holder stay 45, that is, a position, in which the A-direction side end portion of the cam plate 46 is located on the opposite side in the A-direction with respect to the A-direction side end portion of the holder stay 45, the recessed portions of the cam faces 46*b* and the protruded portions of the cam faces 45*e* confront with each other. As a result, the holder stay 45 falls by its own weight so that only the first follower rollers 41 contact with the intermediate conveying rollers 40, as shown in FIG. 5, whereas the second follower rollers 42 are spaced from the intermediate conveying rollers 40.

As described above, in this aspect, the holder stay 45 and the cam plate 16 constitute a roller displacing mechanism for changing the distance between the second follower rollers 42 and the intermediate conveying rollers 40.

The first follower rollers 4 are so arranged that the upstream side of the recording sheet in the conveying direction is directed rearward with respect to the contact points P1 between the intermediate conveying rollers 10 and the first follower rollers 41, as shown in FIG. 4. The second follower rollers 42 are so arranged that the downstream side of the recording sheet in the conveying direction is directed backward with respect to the contact points P2 between the intermediate conveying rollers 40 and the second follower rollers 42 while the second follower roller 42 and the intermediate conveying roller 40 are contacting with each other.

Herein the word "rearward" means a direction in which the recording sheet is conveyed from the contact portion between the heating roller 91 and the recording sheet. In this aspect, the rearward side coincides with the rearward of the laser printer 1.

In the conveying path 31, the conveying path between the turning rollers 32 and the intermediate conveying roller 40 has an enlarged space 31*a*. The enlarged space 31*a* is enlarged rearward from the contact points P1 between the intermediate conveying rollers 40 and the first follower rollers 41, as shown in FIG. 2. The enlarged space 31*a* increases in width toward the rearward direction and toward the upstream (the downward in the drawing) of the conveying direction.

As shown in FIG. 3, the discharge chute 30 is provided with first guide ribs 35 and second guide ribs 36. The first guide ribs 35 and second guide ribs 36 protrude toward the recording sheet (or the conveying path 31) to be conveyed so that leading end sides of the first guide ribs 35 and second guide ribs 36 come into contact with the recording sheet and guide the recording sheet.

The first guide ribs 35 constitute a first guide unit, which is disposed on the upstream side in the conveying direction of the contact portion P1 between the intermediate conveying rollers 40 and the first follower rollers 4 and guides the conveyed recording sheet to the contact points P1 (refer to FIG. 4). The second guide ribs 36 have guide portions 36*a* continuing from the upstream side of the intermediate conveying rollers 40 in the conveying direction to the downstream side of the intermediate conveying rollers 40 in the conveying direction. The second guide ribs 36 constitute a second guide unit for guiding the recording sheet.

The guide portions 36*a* are portions correspond to the leading ends of the second guide ribs 36 and contact the recording sheet to be conveyed so as to guide the conveying direction of the recording sheet. Likewise, the first guide ribs 35 have guide portions 35*a* which are the leading ends of the first guide ribs 35. These leading ends contact the recording sheet to be conveyed, to guide the conveying direction of the recording sheet. The guide portions 35*a* of the first guide ribs 35 end near the contact portion P1.

The protrusion amount of the second guide ribs 36 are set such that, when the second follower rollers 42 are spaced from the intermediate conveying rollers 40 as shown in FIG. 5, the recording sheet discharged from the intermediate conveying rollers 40 is brought into contact with the guide portions 36*a* of the second guide ribs 36 and is conveyed to the downstream side without any collision against the second follower rollers 42.

That is, the second guide ribs 36 are configured such that, when the second drive rollers 42 are spaced from the intermediate conveying rollers 40, the second follower rollers 42 are positioned closer to the image forming unit 10 than the guide portions 36*a* of the second guide ribs 36 when viewed in the direction parallel to the axial direction of the hinge pins 42*b*.

2.3.2. Conveying of Recording Sheet in Discharge Chute and Intermediate Conveying Rollers In the state where the first follower rollers 41 and the second follower rollers 42 contact with the intermediate conveying rollers 40 (refer to FIG. 4), the discharged recording sheet from the fixing unit 90 is guided by the first guide ribs 35 and clamped between the first follower rollers 4 and the intermediate conveying rollers 40.

Then, the discharged recording sheet from the first follower rollers 41 is guided by the second guide ribs 37 to the contact portion P2 between the second follower rollers 42 and the intermediate conveying rollers 40, and is fed out to the discharge rollers 33 while being clamped between the second follower rollers 42 and the intermediate conveying rollers 40.

At this time, the recording sheet is forcibly curled on the intermediate conveying rollers 40, as shown in FIG. 4. As a result, the recording sheet having acquired a bending tendency to bulge rearward is so forcibly curved as to bulge oppositely (or to the front side) thereby to offset the bending tendency (or the curl) having occurred at or downstream of the fixing unit 90.

When the cam plate 46 is operated such that the second follower rollers 42 leave the intermediate conveying rollers 40, the recording sheet, which is guided by the first guide ribs 35 and clamped between the first follower rollers 41 and the intermediate conveying rollers 40 as shown in FIG. 5, is guided by the second guide ribs 36 and is fed to the discharge rollers 33 without being forcibly curled on the intermediate conveying rollers 40.

At this time, the first follower rollers 4 are so arranged that the upstream side of the recording sheet in the conveying direction is directed rearward with respect to the contact points P1 between the intermediate conveying rollers 40 and the first follower rollers 41. As a result, the recording sheet is curved oppositely (or to the front side) of the bending tendency although the degree of curvature is smaller than that of the case (refer to FIG. 4), in which the first follower rollers 41 and the second follower rollers 42 are made to contact with the intermediate conveying rollers 40 thereby to curl the bending tendency of the recording sheet forcibly on the intermediate conveying rollers 40 (as shown in FIG. 4). Therefore, the recording sheet is sufficiently eliminated, if it is so thin and likely to cause the bending tendency.

3. Operations of Laser Printer

As has been described hereinbefore, the second follower rollers 42 arranged on the downstream side in the conveying direction are displaced while the distance between the rotation centers of the first follower rollers 41 and the rotation centers of the intermediate conveying rollers 40 arranged on the upstream side in the conveying direction being constant.

As a result, the contacting facial pressure between the first follower rollers 4 and the intermediate conveying rollers 40 can be held substantially constant. Accordingly, the recording sheet can be sufficiently clamped while preventing the recording sheet from being damaged.

In order to eliminate the bending tendency, it is necessary to curve the recording sheet oppositely to the bending tendency by winding the recording sheet on the intermediate conveying rollers 40. Accordingly, a high conveying resistance occurs in the curved portion (or the conveying path) from the first follower rollers 41 on the upstream side in the conveying direction to the second follower rollers 42 on the downstream side in the conveying direction.

A conveying force is directed toward the intermediate conveying rollers 40 and applied by the heating roller 91 to the recording sheets, which is conveyed toward the intermediate conveying rollers 40. If the recording sheet is not clamped by the first follower rollers 41 on the upstream side in the conveying direction, the recording sheet is buckled and deformed at the curved portion acting as the fixed point.

If the recording sheet is buckled and deformed at the curved portion as the fixed point, the leading end side of the sheet in the conveying direction may possibly be directed to a direction different from the conveying direction along the curved portion. As a result, the sheet jam may occur at the curved portion.

On the other hand, if the first follower rollers 41 on the upstream side in the conveying direction contact with the intermediate conveying rollers 40, the recording sheet is buckled and deformed at the contact points between the first follower rollers 41 and the intermediate conveying rollers 40 on the upstream side in the conveying direction as the fixed point. However, the recording sheet is clamped at the contact between the first follower rollers 4 and the intermediate conveying rollers 40 on the upstream side in the conveying direction, and the distance between the curved portions and the contact points is short. Thus, the recording sheet is hardly buckled and deformed between the curved portions and the contact points.

Therefore, if the recording sheet is always clamped by the first follower rollers 41 on the upstream side in the conveying direction, the recording sheet can be conveyed more stably than that of the configuration disclosed in JP-A-8-175733, in which the recording sheet is always clamped by the follower rollers on the downstream side in the conveying direction.

Accordingly it is possible to provide a laser printer, which can remove the bending tendency reliably for recording sheets of various kinds.

In this aspect, the first guide ribs 35 for guiding the recording sheet to the contact portions P1 between the first follower rollers 41 and the intermediate conveying rollers 40 are provided. As a result, the recording sheet, which is conveyed to the intermediate conveying rollers 40, can be reliably clamped by the first follower rollers 41 and the intermediate conveying rollers 40. Accordingly, the recording sheet can be conveyed stably.

In this aspect, the guide portions 36*a*, which continue from the upstream side in the conveying direction of the intermediate conveying rollers 40 to the downstream side in the conveying direction of the intermediate conveying rollers 10, is provided. As a result, the recording sheet can be guided at its leading end side in the conveying direction along the curved portions. Accordingly, the recording sheet can be conveyed stably.

In this aspect, when the second follower rollers 42 are spaced from the intermediate conveying rollers 40, the discharged recording sheet from the intermediate conveying rollers 40 is conveyed in contact with the second guide ribs 36 to the downstream side without any collision with the second follower rollers 42. When the second follower rollers 42 are spaced from the intermediate conveying rollers 40, therefore, the leading end side of the recording sheet in the conveying direction can be prevented from colliding with the second follower rollers 42 and from being turned in a direction different from the conveying direction. Accordingly, the recording sheet can be conveyed stably.

In this aspect, the first follower rollers 4 and the second follower rollers 42 are connected by the roller holders 44. Therefore, even if the displacing actions of the second follower rollers 42 are repeated over a long period of time, the relative positional relations between the first follower rollers 41 and the second follower rollers 42 can be prevented in advance from being largely changed. Accordingly, the recording sheet can be stably conveyed over a long period of time.

Moreover, the second follower rollers 42 are rocked and displaced on the rotation centers of the first follower rollers 41 so that the movable area of the second follower rollers 42 can be made smaller than that of the case, in which the second follower rollers 42 are moved in parallel. Therefore, the space for mounting the second follower rollers 42 can be secured while suppressing the size increase of the laser printer.

If the configuration is such that the second follower rollers 42 are displaced by rotating the cam plate 46, it is necessary to provide a handle for turning the cam plate 46. Thus, the turning area of the handle has to be retained.

On the contrary, this aspect is configured such that the second follower rollers 42 are displaced by moving the cam plate 46 substantially in parallel with the direction of the roller shafts of the intermediate conveying rollers 40. It is, therefore, unnecessary to secure the turning area of the handle. Thus, it is possible to reduce the size of the mechanism (or the roller displacing mechanism) for displacing the second follower rollers 42.

The recording sheet is heated in the fixing unit 90 and water contained therein evaporates. Thus, the bending tendency is liable to occur especially at the fixing unit 90. Therefore, the bending tendency can be effectively removed, if the intermediate conveying rollers 40 and the pair of follower rollers 41 and 42 having the uncurling function are arranged on the downstream side of the fixing unit 90 in the conveying direction.

The discharge chute 30, which guides the recording sheet while curving the same, is disposed on the downstream side of the fixing unit 90 in the conveying direction and on the upstream side of the discharge rollers 33 in the conveying direction. The intermediate conveying rollers 40 are arranged to curve the recording sheet in the direction opposite to that by the discharge chute 30.

With this configuration, the curvature of the recording sheet by the discharge chute 30 and the curvature of the recording sheet by the intermediate conveying rollers 40 are directionally opposite so that the transfer resistance is increased. Thus, the recording sheet may be caught when it is conveyed by the intermediate conveying rollers 40.

However, in this aspect, the distance between the first follower rollers 4 on the upstream side in the conveying direction and the intermediate conveying rollers 40 is not changed, as described hereinbefore. Accordingly, it is possible to suppress the sheet jam effectively.

Incidentally, the image forming unit 10 corresponds to an image forming unit. The intermediate conveying rollers 40 correspond to a conveying roller. The first follower rollers 4 correspond to a first roller. The second follower rollers 42 correspond to a second roller. The holder stay 45 and the cam plate 46 constitute a roller displacing mechanism. The discharge chute 30 corresponds to a guide member.

Moreover, the first guide ribs 35 correspond to a first guide unit. The second guide ribs 36 correspond to a second guide unit and a third guide unit. The roller holders 44 correspond to a roller holder. The fixing unit 90 corresponds to a fixing unit.

(Other Aspects)

In the aforementioned aspect, the second guide ribs 36 act as the third guide unit and the second guide unit. However, the invention should not be limited thereto but may be additionally provided with guide ribs corresponding to the third guide unit.

In the aforementioned aspects the second guide ribs 36 are rocked and displaced. However, the invention should not be limited thereto. For example, the second guide ribs 36 may be moved in parallel.

Alternatively, either the first guide ribs 35 or the second guide ribs 36 may be eliminated.

In the aforementioned aspect, the pair of follower rollers 41 and 42 is connected by the roller holders 44, but the invention should not be limited thereto.

In the aforementioned aspect, the holder stay 45 and the cam plate 46 constitute a roller displacing mechanism. However, the invention should not be limited thereto. For example, the second follower rollers 42 may be displaced by turning the cam plate.

What is claimed is:

1. An image forming apparatus comprising:

an image forming unit which forms an image on a recording sheet;

a casing which houses the image forming unit and holds the image forming unit;

a conveying roller which applies a conveying force to the recording sheet by contacting with the recording sheet;

a first roller which is fixed to a position confronting the conveying roller, the first roller pushing the recording sheet toward the conveying roller and being rotatable;

a second roller which is arranged at a position confronting the conveying roller and downstream of the first roller in a conveying direction, the second roller being displaceable; and a roller displacing mechanism which displaces the second roller in such a manner as to change a distance between the second roller and the conveying roller, wherein the first roller and the second roller are connected by a roller holder, wherein the second roller is rocked and displaced on a rotation center of the first roller, and wherein the rotation center of the first roller remains fixed and a rotation center of the second roller rotates around the rotation center of the first roller.

2. The image forming apparatus according to claim 1, further comprising a first guide unit which is disposed in an upstream side of a contact portion between the first roller and the second roller in the conveying direction and guides the recording sheet to the contact portion.

3. The image forming apparatus according to claim 2, further comprising a second guide unit which has a guide portion continuing from the upstream side of the conveying roller in the conveying direction to the downstream side of the conveying roller in the conveying direction and guides the recording sheet.

4. The image forming apparatus according to claim 3, wherein, when the second roller is spaced from the conveying roller, the recording sheet discharged from the conveying roller is conveyed to the downstream side being in contact with the second guide unit but without colliding with the second roller.

5. The image forming apparatus according to claim 4, further comprising a third guide unit which guides the recording sheet discharged from the conveying roller to the downstream side without colliding with the second roller when the second roller is maximally spaced from the conveying roller.

6. The image forming apparatus according to claim 1, wherein the image forming unit includes a fixing unit which heats a toner transferred to the recording sheet and fixes the toner on the recording sheet, and wherein the conveying roller is arranged in a downstream side of the fixing unit in the conveying direction.

7. The image forming apparatus according to claim 6, further comprising a discharge roller which discharges the recording sheet having ended an image formation to a discharge tray in a downstream side of the conveying roller in the conveying direction.

8. The image forming apparatus according to claim 7, further comprising a guide member which is disposed in the downstream side of the fixing unit in the conveying direction and an upstream side of the discharge rollers in the conveying direction and guides the recording sheet while curving the same, wherein the conveying roller is arranged to curve the recording sheet in a direction opposite to the curvature by the guide member.

9. The image forming apparatus according to claim 1, further comprising a guide unit which guides the recording sheet discharged from the conveying roller to the downstream side without colliding with the second roller when the second roller is spaced from the conveying roller.

10. An image forming apparatus comprising:

an image forming unit which forms an image on a recording sheet;

a casing which houses the image forming unit and holds the image forming unit;

a conveying roller which applies a conveying force to the recording sheet by contacting with the recording sheet;

a first roller which is fixed to a position confronting the conveying roller, the first roller pushing the recording sheet toward the conveying roller and being rotatable;

a second roller which is arranged at a position confronting the conveying roller and downstream of the first roller in a conveying direction, the second roller being displaceable; and a roller displacing mechanism which displaces the second roller in such a manner as to change a distance between the second roller and the conveying roller, wherein the roller displacing mechanism includes a cam plate which extends substantially in parallel with the rotation axis direction of the conveying roller and is movable parallel to the rotational axis direction of the conveying roller, and wherein the cam plate includes a grip portion which operates the cam plate at a longitudinal end portion thereof.

11. An image forming apparatus comprising:

an image forming unit which forms an image on a recording sheet;

a casing which houses the image forming unit and holds the image forming unit;

a conveying roller which applies a conveying force to the recording sheet by contacting with the recording sheet;

a first roller which is fixed to a position confronting the conveying roller, the first roller pushing the recording sheet toward the conveying roller and being rotatable;

a second roller which is arranged at a position confronting the conveying roller and downstream of the first roller in a conveying direction, the second roller being displaceable;

a roller holder connecting the first roller and the second roller; and a roller displacing mechanism which displaces the second roller in such a manner as to change a distance between the second roller and the conveying roller by rotating the second roller about the center of rotation of the first roller, wherein the center of rotation of the first roller remains fixed and a center of rotation of the second roller rotates around the rotation center of the first roller.

12. The image forming apparatus according to claim 11, further comprising a guide unit which guides the recording sheet discharged from the conveying roller to the downstream side without colliding with the second roller when the second roller is spaced from the conveying roller.

* * * * *